US005289590A

United States Patent [19]

Larson

[11] Patent Number: 5,289,590

[45] Date of Patent: Mar. 1, 1994

[54] COMBINED WORKING TROUSERS AND SAFETY HARNESS

[76] Inventor: Mikael Larson, Mörtån 705, S-840 76 Stugun, Sweden

[21] Appl. No.: 927,491

[22] PCT Filed: Mar. 28, 1991

[86] PCT No.: PCT/SE91/00238

§ 371 Date: Sep. 29, 1992

§ 102(e) Date: Sep. 29, 1992

[87] PCT Pub. No.: WO91/15130

PCT Pub. Date: Oct. 17, 1991

[30] Foreign Application Priority Data

Mar. 30, 1990 [SE] Sweden ..... 9001176-8

[51] Int. Cl.[5] ..... A41D 13/00

[52] U.S. Cl. ..... 2/227; 2/79

[58] Field of Search ..... 2/227, 300, 230, 79, 2/311, 81, 229, 312, 69, 94; 244/143; 248/925; 182/3, 4

[56] References Cited

U.S. PATENT DOCUMENTS 2,081,532 5/1937 Fisch ..... 2/227
2,382,816 8/1945 Quilter et al. ..... 244/143
3,176,793 4/1965 Hlacia ..... 182/3
4,076,101 2/1973 Himmelrich ..... 182/3
4,731,882 3/1988 Ekman ..... 2/79
5,036,548 8/1991 Grilliot et al. ..... 2/227
5,136,724 8/1992 Grilliot et al. ..... 2/227
5,157,790 10/1992 Aldridge ..... 2/227
5,168,582 12/1992 Aldridge ..... 2/230

FOREIGN PATENT DOCUMENTS 2292492 6/1976 France .

*Primary Examiner*—Clifford D. Crowder
*Assistant Examiner*—Amy B. Vanata
*Attorney, Agent, or Firm*—Cushman, Darby & Cushman

[57] ABSTRACT

A combined pair of work trousers and safety harness includes a safety harness secured on a liner in the form of innerwear trousers. The buttocks support band of the harness has end portions which spiral up around the wearer's lower torso to above the wearer's waist in front and project out through slots below a waist belt in a pair of outerwear trousers. The buttocks support band ends are provided with structures which permit the harness to be attached to a safety line. Near those ends, the buttocks support band is secured to a waist belt of the outerwear trousers.

3 Claims, 2 Drawing Sheets

COMBINED WORKING TROUSERS AND SAFETY HARNESS

BACKGROUND OF THE INVENTION

The present invention relates to a pair of work pants having a built-in safety harness.

The term "working trousers" is used herein as a synonym for work pants.

An example of earlier known working trousers combined with a safety harness is described in French Patent Specification No. 2,292,492. The trousers according to this Patent Specification are combined with a safety harness, which according to one alternative can be fastened to the inside of the trousers as an integrated part thereof. The harness straps may be firmly glued, sewn or welded to the inside of the trousers in a manner such that when putting on the trousers, the harness straps will lie in their readiness-positions around the body of the wearer. The harness has coupling devices which are intended to be coupled to a safety line and which are readily accessible on the front of the trousers for connection to the safety line as required.

The object of such a safety harness is that it shall always be found in position around the body of the wearer when the wearer puts the trousers on.

A safety harness intended for a similar purpose is also known from U.S. Pat. No. 2,382,816. This patent, however, does not relate to a pair of working trousers, but to a jacket with a built-in parachute harness. Comprehensive constructional changes would be required in order to alter this jacket into a pair of working trousers with a built-in safety harness intended, for instance, for building workers. Among other things, it would be necessary to cut the American jacket in its waist region and extend its leg openings with trouser legs, such as to form working trousers with legs. It would also be necessary to cut the shoulder straps supporting the harness at the waist strap. The lining of the jacket is sewn firmly to the jacket waist band. It would also be necessary to extend the waist band and provide said band with a buckle so as to provide a tightenable waist belt. The axle straps merge with a transverse strap having a rearwardly located centre part to which the ends of thigh straps are fastened, said thigh straps forming forwardly located parts of adjustable lengths and are fastened to the shoulder straps. This centre part of the strap is not fastened to the lining.

Neither are the tie scraps of the American harness sewn firmly to the lining, but lie freely in tunnels provided on the rear side of the jacket and formed by folding-over and sewing collars on the rear side of the lining.

In the case of the American jacket, it is necessary to extend the leg openings of the lining with leg portions which extend down into the trouser legs.

Other alterations must be made in order for the American jacket to correspond to the type of working trousers of the present invention in order to ensure that the safety harness of the trousers will adopt a close position relative to adjacent parts of the body and therewith prevent excessive, free movement of harness parts before the parts come into contact with adjacent body parts. This greatly reduces the risk of jolting which is liable to occur with wide working trousers provided with known built-in safety harnesses.

Working trousers are normally spacious, with wide legs, to afford the wearer the best possible freedom of movement. Consequently, the safety harness fastened to the inside of the trousers must be adapted to the size of the trousers concerned, which in turn means that the harness will be larger than is desired with respect to the fact that the different strap-parts around the thighs and hips of the wearer will not need to move freely to an excessive extent prior to being brought into abutment with respective parts of the body. This free movement namely enables the various parts of the harness and the trouser parts to which they are fastened to be placed in different positions against respective parts of the body and in some cases to be so wrongly positioned that the harness can cause injury to the wearer should he/she fall unintentionally or be brought to a halt by the harness.

SUMMARY OF THE INVENTION

Accordingly, the object of the present invention is to provide working trousers comprising a safety harness which will always take a substantially correct position in the worker's trousers relative to adjacent body parts.

In order to achieve this object in the easiest possible manner, the invention is based on a special type of safety harness which is arranged in the trousers, and therewith avoid the drawbacks associated with known working trousers fitted with a safety harness.

The known harness, which is used in the working trousers of the present invention, in the preferred embodiment, has two ring-shaped thigh-band rings which arc intended to lie around the wearer's thighs in the proximity of the wearer's crotch. The rear parts of the rings are joined by a transverse band or strap which lies in the proximity of the wearer's bottom and is intended to be held in this position. This transverse band extends on both sides and obliquely upwards to the front of the trousers, where the end parts of said transverse band are fastened to the waist belt, which is constituted by a relatively broad band. The end parts extend above the waist belt and are provided with eyes or loops for connection to a safety line, when necessary.

According to the present invention, the harness is completely free from the insides of the trousers by virtue of the fact that the thigh rings are fastened around the legs of inner trousers, the upper edge of which is fastened to the inside of the outer trousers at the upper edge thereof. The band rings are thus suspended from the inner trousers and take the most suitable height position relative to the wearer's crotch. The centre part of the transverse belt will therewith be held in a desired readiness-position in relation to the bottom of the wearer.

Since the thigh rings are not fastened to the inside of the legs of the trousers, which legs can be relatively wide in some instances, the size of the rings can be chosen to suit the most common thigh sizes of relevant trouser sizes, with desired clearance of play. The transverse belt is, in turn, suspended from the waist belt and the length of the transverse band is adapted so that the centre part of said band between the rings will be located in a desired position relative to the wearer's bottom, this position being achieved by the fact that the transverse band is fastened to the thigh rings.

When the wearer puts the trousers on, his or her feet and legs will be guided down into the inner trousers without obstruction from the various band parts of the harness, and when the waist belt is tightened, the harness will hang down in a correct position and be freely movable relative to the inside of the trousers.

The legs of the inner trousers are relatively short and only slightly longer than that required to fasten the harness rings in correct positions outside the legs of the inner trousers.

A further advantage provided by the inner trousers is that they enable the user to wear underpants with short legs, since the thighs of the wearer lie against the inner trousers, thereby preventing chaffing against the band parts of the harness.

BRIEF DESCRIPTION OF THE DRAWING

The invention will now be described in more detail with reference to a preferred exemplifying embodiment thereof illustrated in the accompanying drawings, in which.

DETAILED DESCRIPTION

Figure 1:
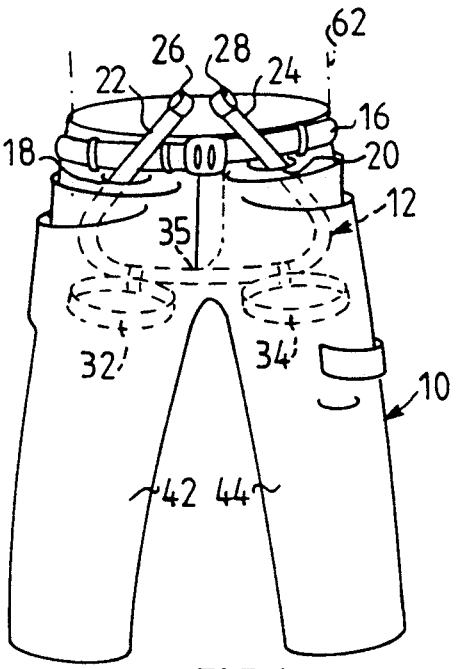
FIG. 1 is a schematic, perspective view of working trousers according to the invention, seen from the front.

The working trousers are identified generally by the reference numeral 10, a safety harness by the reference numeral 12 and a pair of inner trousers by the reference numeral 14.

The trousers 10 are provided with a waistbelt 16.

Provided in respective front pieces of the working trousers, beneath the waistbelt, are two slot-like openings 18, 20 through which free end-parts 22, 24 extend upwardly and are secured to the waistbelt, for instance with the aid of seams, and extend above the waistbelt and provided with eyes or loops 26, 28, which are intended to be coupled to a safety line in a known manner, when necessary.

The harness 12 includes two band rings 32, 34 which pass around the wearer's thighs, with a desired clearance, and which are intended to lie in a readiness-position approximately on a level with the crotch of the wearer. The rear parts of the ring 32, 34 are fastened to the centre part 35 of a transverse band by means of a connecting band 36 sewn firmly to said centre part 35, said transverse band supporting the wearer's bottom.

The centre part 35 extends outwards in two side-band parts 38, 40, which extend obliquely upwards around the wearer's hips and merge on the front side with the aforesaid end-parts 22 and 24 respectively.

If the wearer should fall, his or her bottom will be caught by the centre part 35, which is held in a correct readiness-position by means of the band rings 32, 34, which also contribute in taking up the forces that occur, to some extent.

The working trousers 10 are relatively roomy, so as not to inhibit the wearer's movements and the trousers legs 42, 44 have a corresponding width. If the harness band rings were to be fastened around their periphery to the inside of the trouser legs 42, 44 in the illustrated readiness-position in a conventional known manner, it would be necessary to use substantially larger band rings than the illustrated band rings 32, 34. This, in turn, would result in an undesirable increase in freedom movement of the rings forwards and backwards respectively in relation to the thighs, which in turn would mean that the position of the centre part of the transverse band 34 relative to the wearer's bottom might possibly change, which in some cases would cause said centre part to lie so far out from the wearer's bottom as to prevent said centre part from supporting against the wearer's bottom when bringing the wearer to a halt in the event of a fall. In this case, should the centre part 35 move to a position above the wearer's bottom, all load would be transferred to the band rings, designed for a large size, with the risk of seriously injuring the crotch region of the wearer.

This risk is eliminated with the trousers, in that the safety harness is dimensioned with rings 32, 34 which lie around the wearer's thighs in a positive and safe fashion while still providing a comfortable amount of space.

In order to hold the rings in a correct readiness-position, so as to ensure that the centre part 35 of the transverse band is in the desired correct readiness-position, the harness is disposed on the outside of inner trousers 14 which have short legs 48, 50.

The upper edge of the inner trousers is firmly sewn, with a seam 52, along the inside of the upper edge part of the outer trousers and also along the edges of the fly-opening, with seams 54, 56.

The harness is disposed externally on the inner trousers with the band parts 38, 40 lying loosely around the inner trousers The centre part 35 of the transverse band is fastened to the outside of the inner trousers with the aid of one or more seams 58. The rings 32, 34 lie around the legs 48, 50 of the inner trousers and are fastened to the inner trousers with a plurality of seams 60, so that when the inner trousers hang freely down in the working trousers, due to the weight of the rings 32, 34 and the weight of the centre part 35, the rings and the centre part will take a correct height position with the centre part in a desired readiness-position in the proximity of and below the wearer's bottom.

The harness is manufactured from strong bands which are, nevertheless, relatively light in weight and therefore will not hamper the wearer.

The inner trousers are preferably made of a perforated fabric material, to permit the circulation of air.

Figure 2:
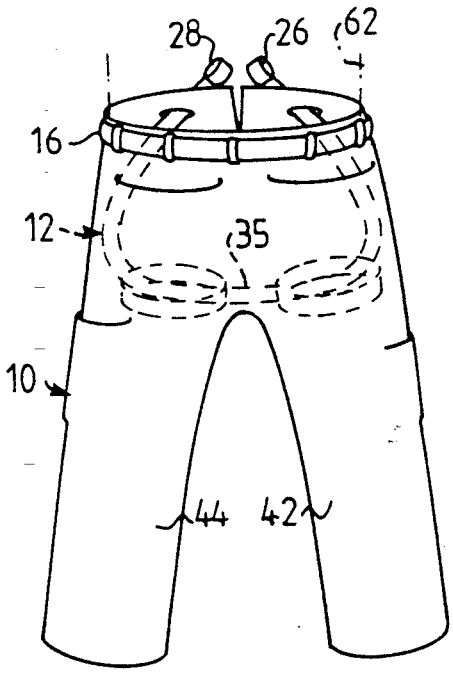
FIG. 2 is a back view of the trousers.
Figure 3:
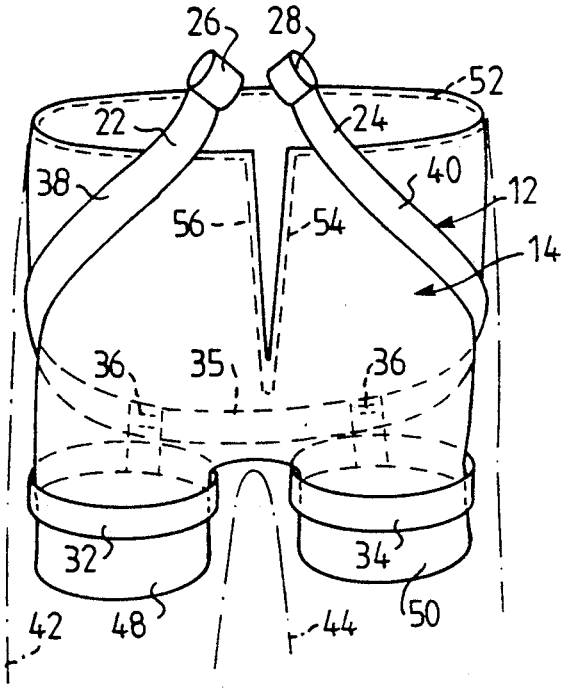
FIG. 3 illustrates inner trousers with the harness arranged outside said trousers, said harness in some instances being secured to the inner trousers, the outer working trousers being shown schematically in chain lines.
Figure 4:
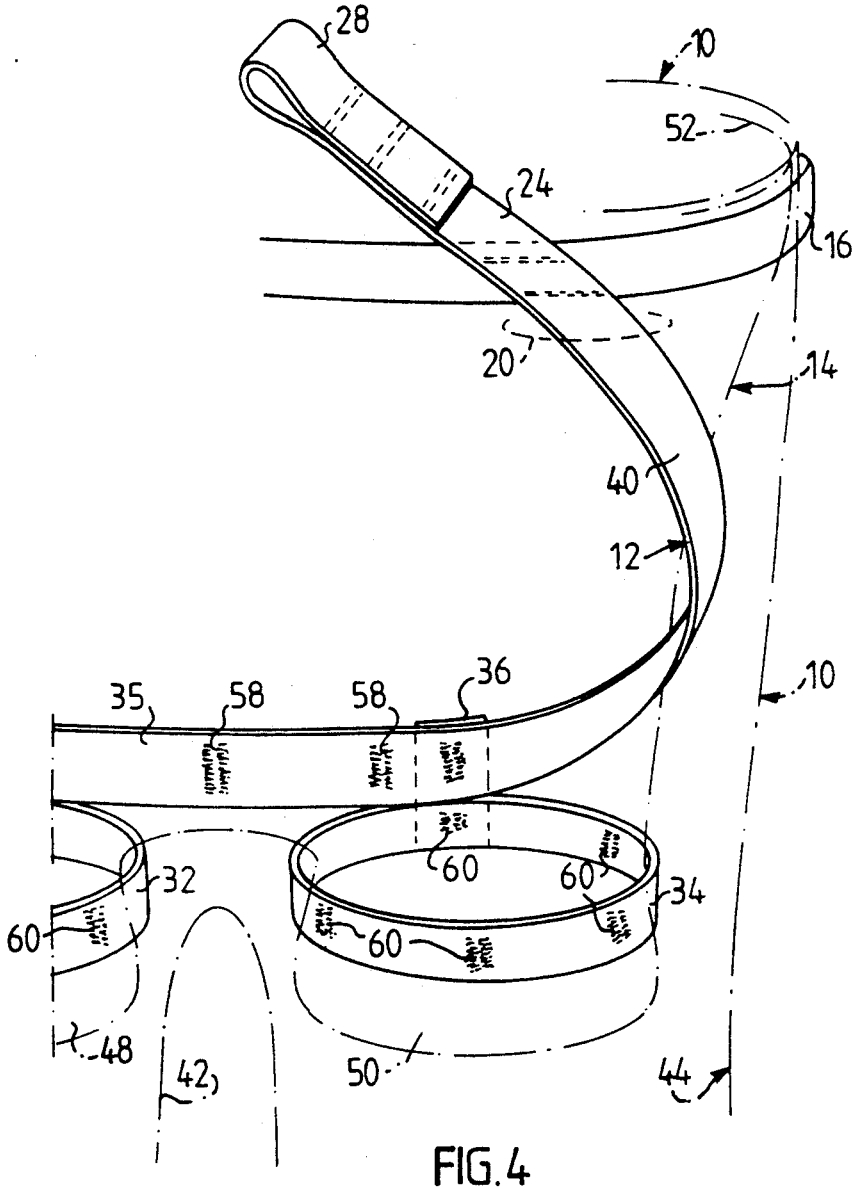
FIG. 4 is an enlarged, broken view in perspective which illustrates schematically part of the safety harness outside a part of a pair of inner trousers, with the inner trousers extending down in the working trousers.

The front part of the working trousers may be extended upwards, in a known manner, to form a chest part 62, shown in chain lines in FIGS. 1 and 2, which can be connected to a pair of braces, in a known manner.

Alternatively, the safety harness may be incorporated in overalls comprising inner trousers, which then form part of the lining of the overalls, the rings of the safety harness being attached around the trouser legs of the lining and fastened thereto. In some cases, the user may also use a chest harness, in addition to the aforedescribed hip harness, which is then connected together with the hip harness.

I claim:

1. A pair of work trousers having a built-in safety harness, comprising:

a safety harness including:

two thigh bands arranged to encircle a wearer's respective thighs adjacent the wearer's crotch;

a buttocks support band having a transversely extending central portion arranged to engage a wearer's buttocks from below and thereby potentially support the wearer from under those buttocks; the buttocks support band further including end portions which are arranged to spiral from opposite ends of said central portion, upwards and laterally outwards, forwards and then medially inwards and terminate adjacent one another in front of the wearer, near the wearer's waist, in respective structures adapted for attachment to a safety line for potentially supporting the wearer via the buttocks support band;

securements securing the two thigh bands at rear portions thereof, besides one another to said central portion of said buttocks support band;

a pair of lining trousers having two respective leg portions depending from a torso portion having an upper end;

a pair of outerwear trousers having two respective leg portions depending from a torso portion having an upper end provided with a waist belt for closely encircling the wearer's waist;

securements securing the thigh bands and buttocks support band of the safety harness onto the pair of lining trousers;

said pair of outerwear trousers having means defining two slots provided therethrough frontally of said torso portion thereof adjacent said waist belt;

a securement securing plural sites on said upper end of said lining trousers to corresponding plural sites on said upper end of said outerwear trousers;

upper parts of said end portions of said buttocks support band extending out from between said lining trousers and said outerwear trousers through respective ones of said slots so that said structures adapted for attachment to a safety line are accessible frontally of the wearer from outside said outerwear trousers; and securements securing said upper parts of said end portions of said buttocks support band to said waist belt.

2. The pair of trousers of claim 1, wherein:

said torso portion of said lining trousers frontally includes a fly opening that is contiguous with said upper end thereof, said opening being bounded by an edge, and said torso portion of said outerwear trousers correspondingly frontally includes a fly having side margins; and further including securements securing corresponding portions of said edge of said fly opening of said lining trousers to said side margins of said fly of said outerwear trousers.

3. The pair of work trousers of claim 1, wherein:

said securements securing said thigh bands and buttocks support band to said pair of lining trousers includes sewn seams.

* * * * *